US005122077A

United States Patent [19]

Maejima et al.

[11] Patent Number: 5,122,077

[45] Date of Patent: Jun. 16, 1992

[54] MULTI-STAGE CONNECTOR

[75] Inventors: Toshiro Maejima; Masaru Fukuda; Seiji Kozono; Masakuni Samejima, all of Shizuoka, Japan

[73] Assignee: Yazaki Corporation, Tokyo, Japan

[21] Appl. No.: 602,043

[22] Filed: Oct. 3, 1990

Related U.S. Application Data

[63] Continuation of Ser. No. 439,762, Nov. 21, 1989, abandoned.

[30] Foreign Application Priority Data

Nov. 24, 1988 [JP] Japan ..... 63-294629
Nov. 29, 1988 [JP] Japan ..... 63-299708

[51] Int. Cl.[5] ..... H01R 4/24

[52] U.S. Cl. ..... 439/398; 439/404; 439/717

[58] Field of Search ..... 439/289, 285, 287, 291–294, 439/711–715, 717, 404–407, 395–400, 417–419

[56] References Cited

U.S. PATENT DOCUMENTS

| | | | |
|---|---|---|---|
| 3,848,951 | 11/1974 | Michaels et al. | 439/417 |
| 4,354,719 | 10/1982 | Weidler | 439/398 |
| 4,671,601 | 6/1987 | Zomecka | 439/404 |
| 4,693,533 | 9/1987 | Syczesny et al. | 439/404 |
| 4,753,608 | 6/1988 | Yamaguchi | 439/417 |
| 4,753,613 | 6/1988 | Morgan | 439/291 |
| 4,830,625 | 5/1989 | Vignoli | 439/417 |

*Primary Examiner*—David I. Pirlot
*Attorney, Agent, or Firm*—Sughrue, Mion, Zinn, Macpeak & Seas

[57] ABSTRACT

A multi-stage connector is disclosed in which a plurality of connector housings each having open terminal receiving chambers are slidably received in a connector housing body in a multi-stage stacked manner; a retainer projection and a fixing projection are formed on an outer surface of the connector housing; a real retainer window and a provisional retainer window are formed in the connector housing body and juxtaposed in a direction of pulling of the connector housing; and a cover having fixing windows is engaged with the fixing projections.

5 Claims, 8 Drawing Sheets

MULTI-STAGE CONNECTOR

This is a continuation of application Ser. No. 07/439,762 filed Nov. 21, 1989, now abandoned.

BACKGROUND OF THE INVENTION

This invention relates to a multi-stage connector in which a plurality of connector housings can be easily connected together, and to a method of press-connecting an electric wire by interconnecting the connector housings.

FIG. 1 is a perspective view of a conventional multi-stage connector in its condition prior to the assembling thereof. FIG. 2 is a perspective view of this conventional connector in its assembled condition.

In FIGS. 1 and 2, reference numeral 22 denotes a lower connector housing, and reference numeral 23 denotes an upper connector housing. These two connector housings 22 and 23 are connected together by a flexible connecting band 24. Reference numeral 25 denotes a retainer cover having a connection-retaining window 26, and reference numerals 27 and 28 denote retainer projections.

After electric wires (not shown) are connected respectively to press-connecting terminals 30 mounted respectively in terminal receiving chambers 29, the retainer cover 25 is arranged to cover the lower connector housing 22 with the retainer projection 27 engaged in the connection-retaining window 26. Then, the upper connector housing 23 is turned in a direction indicated by an arrow A to be superimposed on the lower connector housing 22 through the retainer cover 25, with the retainer projection 28 engaged in the connection-retaining window 26, thus assembling the multi-stage connector.

However, in the above conventional multi-stage connector, the connector housings 22 and 23 are connected together by the connecting band 24, and therefore where the connector housings are connected together in more than two stages, the arrangement in the direction of assembling (the direction of the arrow A) becomes complicated, which results in a problem that the assemblage can not be carried out easily.

Another problem is that if the connecting band 24 should be damaged, the whole of the connector would be unusable.

Further, the connection of the wires to the press-connecting terminals 30 has required much time and labor.

With the foregoing in view, it is an object of this invention to provide a multi-stage connector and a method of press-connecting a wire, in which connector housings can be easily connected together in more than two stages, and there is provided a good interchangeability at the time when the component parts are damaged, and the press-connection of the electric wire can be carried out in less time and labor.

To achieve the above object, the present invention basically provides a multi-stage connector characterized in that a connective member is provided on a connector housing; a provisional retainer projection and a main retainer projection are provided on a connector housing to be connected to the first-mentioned connector housing in opposed relation thereto, said retainer projections being juxtaposed in the direction of the connection; said connective member is sequentially engageable with said provisional retainer projection and said main retainer projection. Further, advantageously, a press-connecting portion of a press-connecting terminal is provided on said connector housing to be connected, said press-connecting portion being upstanding in the direction of the connection, and an electric wire-pressing projection being formed on said first-mentioned connector housing to be opposed to said press-connecting terminal.

Further, according to the present invention, there is provided a method of press-connecting an electric wire in said multi-stage connector, said method comprising the steps of placing the electric wire on said press-connecting terminal with said connective member engaged with said provisional retainer projection; and engaging said connector member with said main retainer projection, so that said electric wire-pressing projection connects the wire to said press-connecting terminal.

A plurality of connector housings can be easily connected in a multi-stage stacked manner by fitting the retainer projection of the connector housing in the connective member of the mating connector housing.

Since the connector housings are identical in shape and hence are interchangeable, the maintenance is easy.

Further, when the connector housings are connected together, if the electric wire is placed on the press-connecting terminal with the connective member engaged with the provisional retainer projection to provide a provisional retaining condition, then the connection of the electric wire can be done at the same time when the connector housing is pressed or urged in the direction of the connection by an automatic device or the like to connect the connective member to the retainer projection.

According to another aspect of the present invention, there is provided a multi-stage connector characterized in that a plurality of connector housings each having open terminal receiving chambers are slidably received in a connector housing body in a multi-stage stacked manner; a retainer projection and a fixing projection are formed on an outer surface of said connector housing; a main retainer window and a provisional retainer window are formed in said connector housing body and juxtaposed in a direction of pulling of said connector housing; and a cover having fixing windows is engaged with said fixing projections. The present invention also provides a multi-stage connector characterized in that a slide rail is formed on a wall of each of a plurality of connector housings each having open terminal receiving chambers; a slide rail-engaging groove is formed in another wall of said connector housing disposed in opposed relation to said first-mentioned wall; said slide rail of said connector housing is engaged in said slide rail-engaging groove of its adjoining connector housing, thereby arranging said plurality of connector housings in a multi-stage stacked manner.

In the former means, one connector housing is pulled or drawn at a time, and the retainer projection is engaged in the provisional retainer window of the housing body, and in this condition the terminal connection is carried out through the open portion of the terminal receiving chamber. After the connection is completed, the connector housing is returned to its closed position, so that the retainer projection is engaged in the retainer window. Such terminal connection as well as the sliding movement (pulling and closing) of the male connector housing can be effected using an automatic device.

In the latter means, a desired number of connector housings can be arranged in multi-stage stacked relation by engaging the slide rail of each connector housing in the slide rail-engaging groove of its adjoining connector housing. The connection between the connector housings can be done by an automatic device.

BRIEF DESCRIPTION OF THE DRAWINGS

FIG. 9(*b*) is an enlarged perspective view of a retainer projection of the connector of FIG. 9(*a*);

DESCRIPTION OF THE PREFERRED EMBODIMENTS

Figure 1:
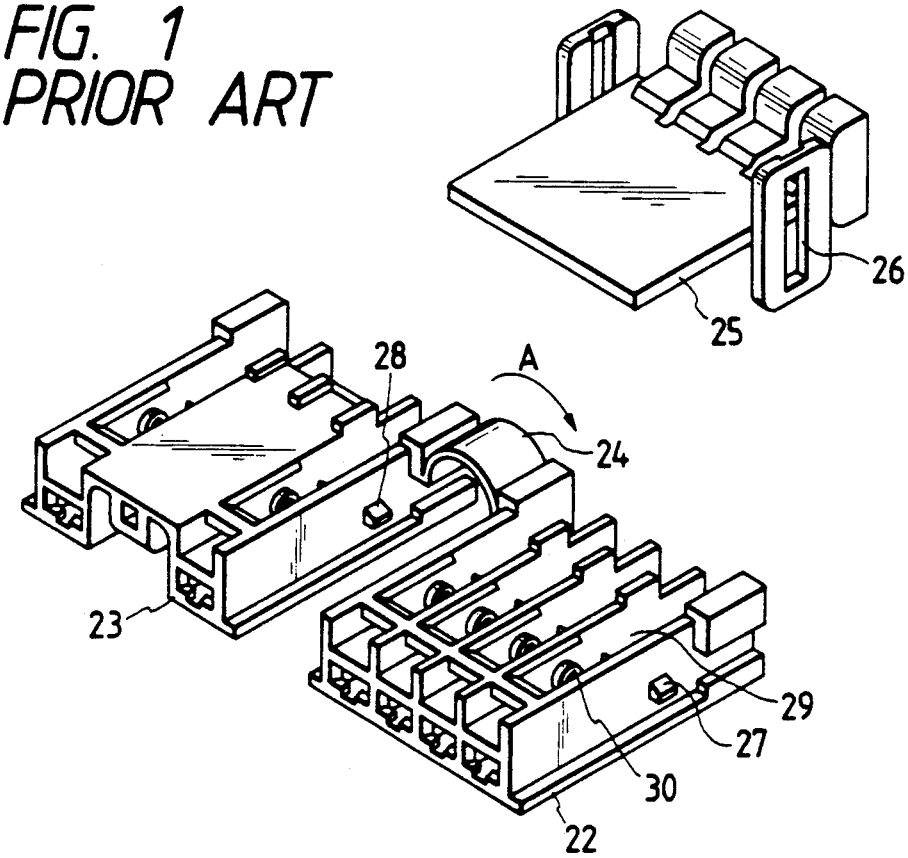
FIG. 1 PRIOR ART
FIG. 1 is a perspective view of a conventional multi-stage connector in its condition prior to the assemblage thereof.
Figure 2:
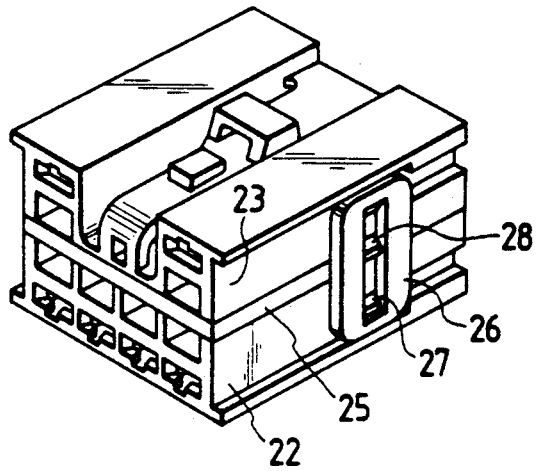
FIG. 2 PRIOR ART
FIG. 2 is a perspective view of the conventional multi-stage connector in its assembled condition.
Figure 3:
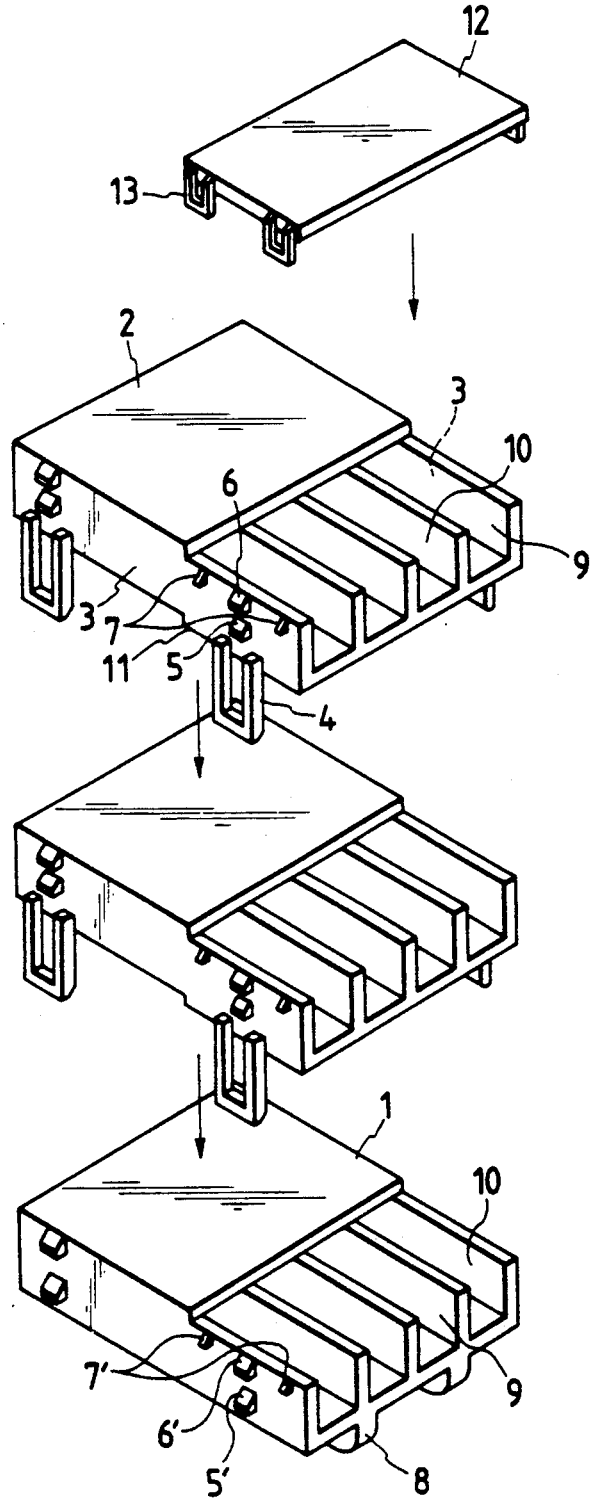
FIG. 3 is an exploded perspective view of a multi-stage connector provided in accordance with the present invention.

FIG. 3 is an exploded perspective view of a multi-stage connector according to a first embodiment of the present invention.

In the drawings, reference numeral 1 denotes a base housing, and reference numeral 2 denote an adapter housing which can be commonly used as the upper stage and intermediate stage of the connector. The use of the adapter housings 2 enables a desired number of stages of the connector.

More specifically, connective members 4 and 4 of a generally U-shaped are formed integrally with each of opposite side walls 3 and 3 of the adapter housing 2, the connective members 4 and 4 depending from the lower portions of the side wall 3 adjacent to the opposite ends of the side wall 3. Main retainer projections 5 and 5 are formed on the side wall 3 and are respectively disposed above the connective members 4 and 4, that is, intermediate the width of the side wall 3. Provisional retainer projections 6 and 6 are formed on the upper portion of the side wall 3 and are respectively disposed in opposed relation to the real retainer projections 5 and 5. Cover retainer projections 7 and 7 are formed on the side wall 3 and are disposed respectively on the opposite sides of one of the provisional retainer projections 6 and 6 disposed close to one end of the side wall 3. A desired number of adapter housings 2 can be connected together by engaging the connective members 4 with the retainer projections 5 and 6.

The base housing 1 is generally similar in shape to the adapter housing 2, but is not provided with the connective members 4. The base housing 1 has real retainer projections 5', provisional retainer projections 6' and cover retainer projections 7'. The base housing 1 also has seat portions 8 formed on its bottom wall.

The base housing 1 as well as each adapter housing 2 has a plurality of juxtaposed terminal receiving chambers 9 therein. Each terminal receiving chamber 9 has one open end, and a portion of the upper wall of the terminal receiving chamber 9 extending from this one end is removed to provide an opening.

A lid portion 11 formed integrally with the adapter housing 2 at its bottom portion is arranged to cover an open portion 10 of the base housing 1, and an open portion 10 of the adapter housing 2 is covered by the lid portion of the adjoining adapter housing 2. The open portion 10 of the uppermost adapter housing 2 is covered by a cover 12. The cover 12 has connective members 13 smaller in size than the above-mentioned connective members 4. The connective members 13 are adapted to be engaged respectively with the cover retainer projections 7.

The lid portion 11 as well as the cover 12 has electric wire-pressing projections at the lower surface thereof as later described.

FIG. 3 shows the condition in which the three stages (connector housings) of the multi-stage connector are provisionally retained.

Figure 7:
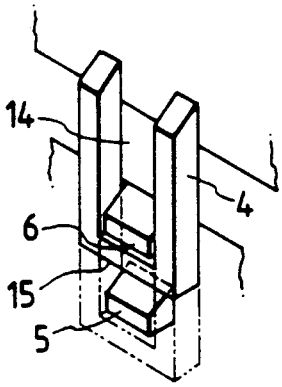
FIG. 7 is an enlarged fragmentary view showing retainer means.

More specifically, windows 14 of the connective members 4 of the adapter housing 2 are engaged respectively with the provisional retainer projections 6 (6') of its lower adjacent connector housing, with the distal end 15 of each connective member 4 abutted against the upper surface of the corresponding real retainer projection 5 (5'), as shown in solid lines in FIG. 7, FIG. 7 showing the manner of engagement of the connective members 4 with the retainer projections 5 and 6. The connective members 13 of the cover 12 are respectively engaged at their lower ends with the upper ends of the cover retainer projections 7.

Figure 5:
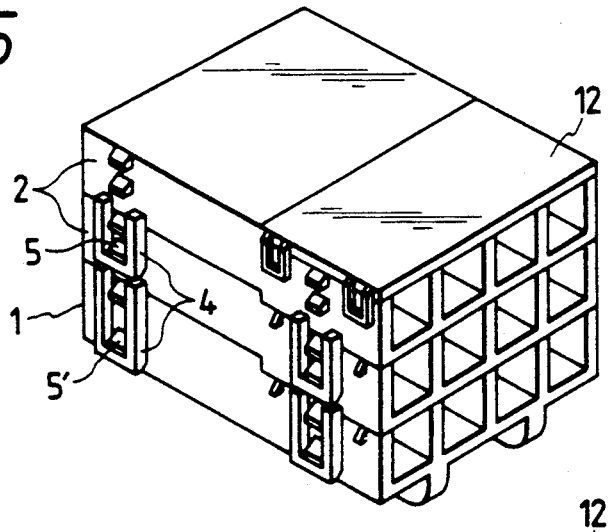
FIG. 5 is a perspective view of the multi-stage connector in its completely retained condition.

In this condition the adapter housing 2 of the uppermost stage (the cover 12) is pressed in a direction of an arrow B, thereby completing the assemblage of the connector, as shown in FIG. 5. More specifically, the connective members 4 are fitted respectively on the reel retainer projections 5 and 5', with the windows 16 of the cover connective members 13 slidingly fitted respectively on the cover retainer projections 17.

Figure 6:
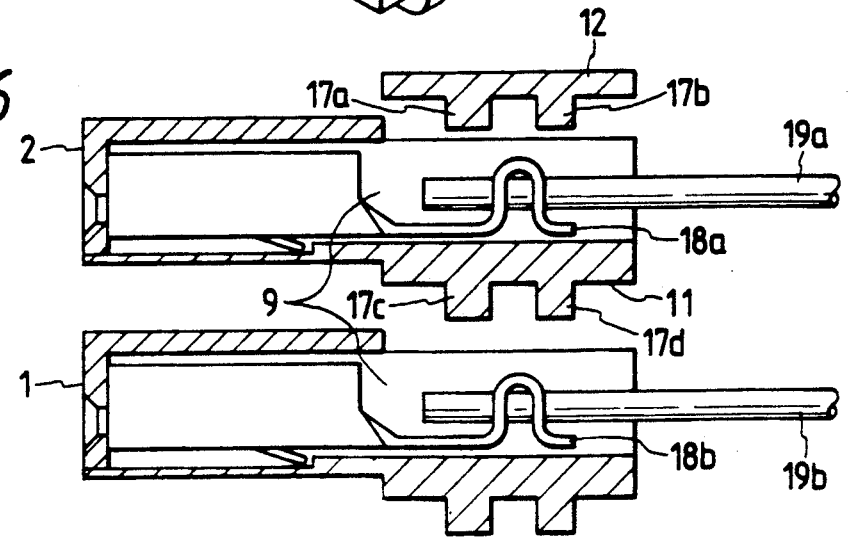
FIG. 6 is a cross-sectional view showing the manner of press-connecting electric wires to the multi-stage connector.

FIG. 6 shows the manner in which the electric wires 19*a* and 19*b* are connected respectively to press-connecting terminals 18*a* and 18*b* by the electric wire-pressing projections 17*a* to 17*d* formed on the cover 12 and the bottom portion (lid portion) of the adapter housing 2.

Figure 4:
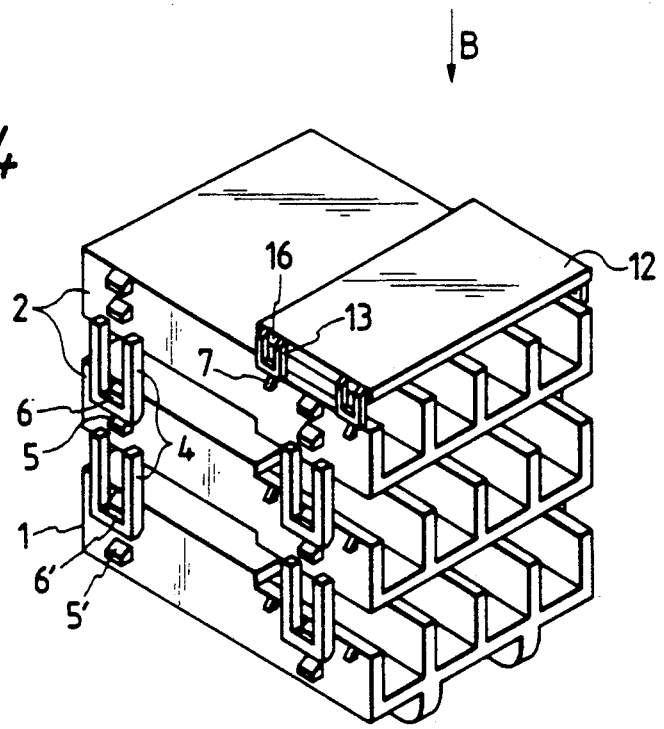
FIG. 4 is a perspective view of the multi-stage connector in its provisionally retained condition.
Figure 8:
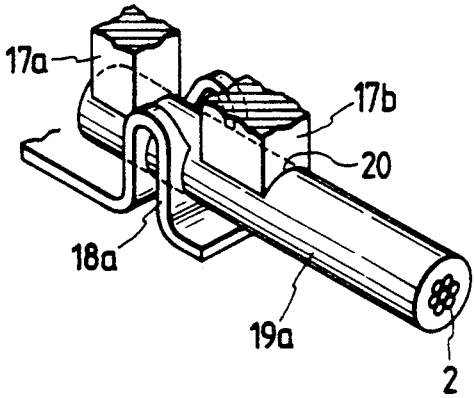
FIG. 8 is a cross-sectional view explanatory of the above press-containing manner.
Figure 9A:
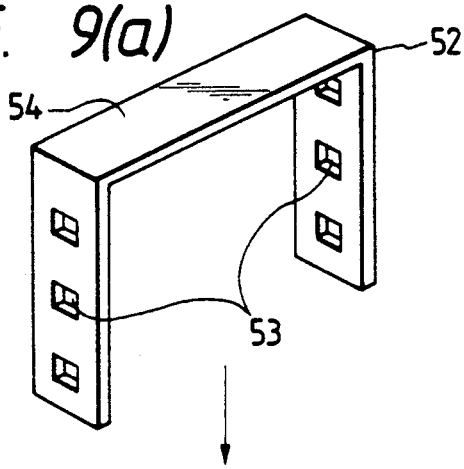
FIG. 9(*a*) is an exploded perspective view of a multi-stage connector according to a second embodiment of the present invention.
FIG. 9(c) is an enlarged perspective view of a fixing projection of the connector of FIG. 9(*a*)
Figure 9B:
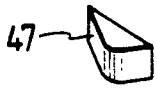
Figure 9C:
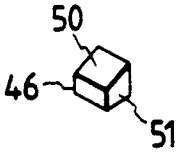
Figure 9C:
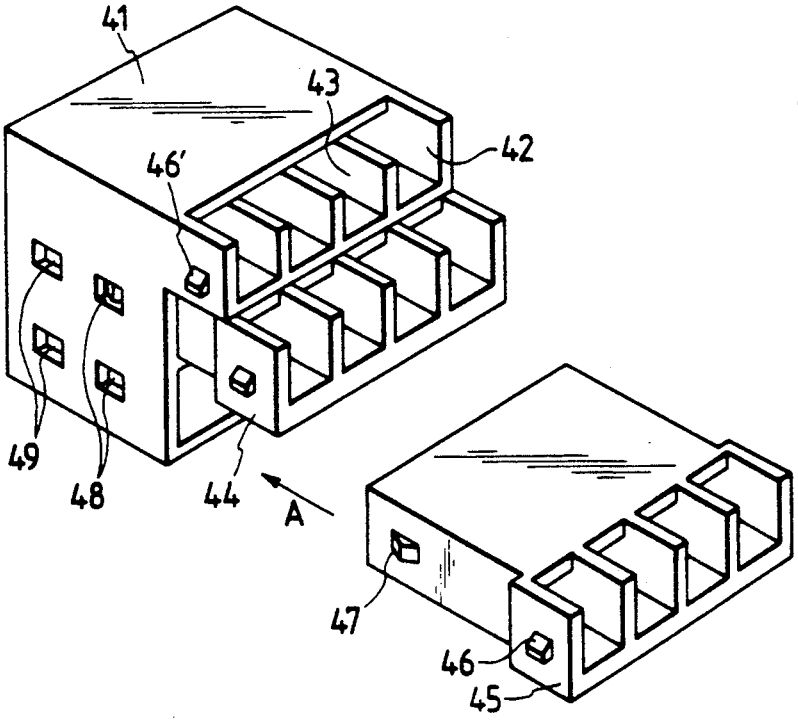

More specifically, the press-connecting terminal 18*a* and 18*b* are mounted in the respective terminal receiving chambers 9 of the base 1 and the adapter housings 2. In the provisionally retained condition shown in FIG. 4, the electric wires 19*a* and 19*b* are placed respectively on the press-connecting terminals 18*a* and 18*b*. Then, when the complete retaining is effected as shown in FIG. 5, the electric wires 19*a* and 19*b* are pressed by the corresponding electric wire-pressing projections 17*a* to 17*d* and connected respectively to the press-connecting terminals 18*a* and 18*b* (see FIG. 8).

In order to facilitate the pressing of the electric wire into the press-connecting terminal 18*a* (18*b*), the electric wire-pressing projections 17*a* and 17*b* (17*c* and 17*d*) are so arranged that these projections can be disposed adjacent to and on the opposite sides of the press-connecting terminal 18*a* (18*b*) in the direction of the axis of the electric wire. The distal end 20 of each of the pressing projections 17*a* to 17*d* is arcuately concave so as to conform with the diameter 21 of the electric wire.

As described above, in the present invention, the plurality (desired number) of connector housings can be easily connected together at one time by an automatic device or the like. At the same time, the electric wires can be connected respectively to the mating press-connecting terminals. Therefore, the time and labor required for the assemblage of the connector as well as the time and labor required for the connection of the wires can be reduced.

Further, the component parts (connector housings) are common, and therefore this is very advantageous from the viewpoint of the manufacture. In addition, because of the interchangeability of the parts, the maintenance can be easily carried out, for example, when the part is damaged.

FIG. 9(*a*) is an exploded perspective view of a second preferred embodiment of a multi-stage connector provided in accordance with the present invention.

In FIG. 9(*a*), a connector housing body 41 has a plurality of terminal receiving chambers 42 at its upper stage. The opposite end walls of each terminal receiving chamber 42 are removed to provide opposite open ends of the terminal receiving chamber 42, and a portion of the upper wall of the terminal receiving chamber 42 close to one end thereof is also removed to provide an opening. A press-connecting terminal is mounted in this open portion 43, and an electric wire (later described) can be passed through the open portion 43 and pressed-connected to the press-connecting terminal by an automatic device (not shown).

In FIG. 9(*a*), slide housings (male connector housings) 44 and 45 can be slidably received respectively in the intermediate stage and lower stage of the connector housing body 41.

A fixing projection 46 and a retainer projection 47 are formed on each of the opposite side walls of the slide housing 44, 45, these projections 46 and 47 being spaced from each other in the direction of the sliding movement of the slide housing. A provisional retainer window 48 and a real retainer window 49 are formed through each of the opposite side walls of the connector housing body 41, and are juxtaposed in the direction A of the sliding movement. The retainer projection 47 is engageable with each of the provisional retainer window 48 and the real retainer window 49.

In FIG. 9(*a*). reference numeral 46' denotes a fixing projection formed on the connector housing body 41.

FIG. 9(*b*) is an enlarged view of the retainer projection 47, and the retainer projection 47 has a triangular shape symmetrical with respect to a center plane thereof. FIG. 9(*c*) is an enlarged view of the fixing projection 46, and the fixing projection 46 has an inclined upper surface 50 and a lower surface 51 disposed perpendicular to the side wall of the slide wall of the slide housing 45.

A housing cover 52 has fixing retainer windows 53 formed through opposed walls thereof. The retainer windows 53 are engageable with the fixing projections 46 and 46', and an upper wall 54 of the housing cover 52 is adapted to cover the upper side of the open portion 43 of the connector housing body 41.

Figure 10:
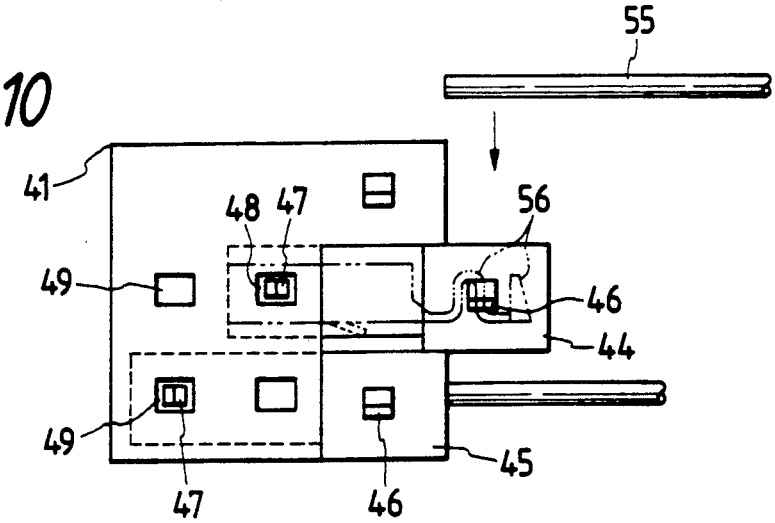
FIG. 10 is a front-elevational view of the multi-stage connector, showing the manner of connecting an electric wire to the connector of FIG. 9(*a*)

FIG. 10 is a front-elevational view of the multi-stage connector of FIG. 9(*a*), showing the manner of press-connecting the electric wires 55.

In FIG. 10, reference numeral 56 denotes the press-connecting terminal. The slide housing 44 of the intermediate stage is held in a provisionally retained condition (that is, with each retainer projection 47 engaged in the corresponding provisional retainer window 48), and in this condition the electric wire 55 is press-connected to the terminal 56 from above by the automatic device (not shown). Therefore, in this embodiment, the space required for the press-connecting operation is less than that conventionally required.

In FIG. 10, the press-connecting operation has already been completed with respect to the slide housing 45 of the lower stage, and the slide housing 45 is disposed in a complete retained condition (that is, with each retainer projection 47 engaged in the corresponding real retainer window 49).

Figure 11:
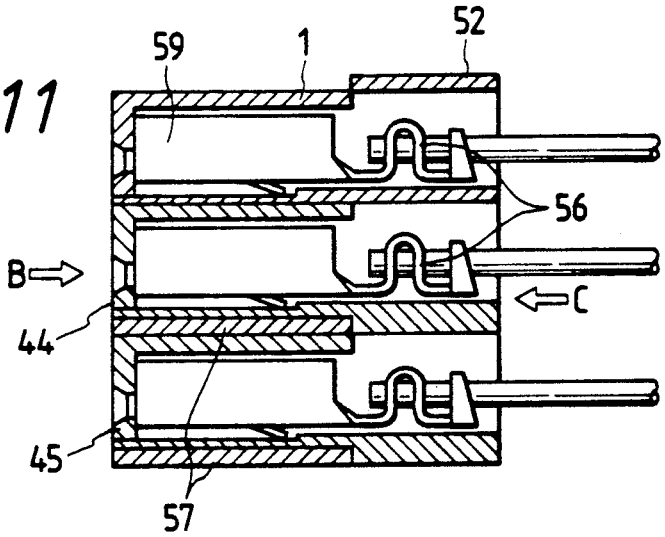
FIG. 11 is a cross-sectional view of the multi-stag connector, showing the manner of assembling it.

The slide housing 44, 45 is moved by the automatic device in directions of arrows B and C (FIG. 11) so as to be pulled and pushed (closed) with respect to the connector housing body. In FIG. 11, reference numeral 57 denotes a guide wall.

Figure 12:
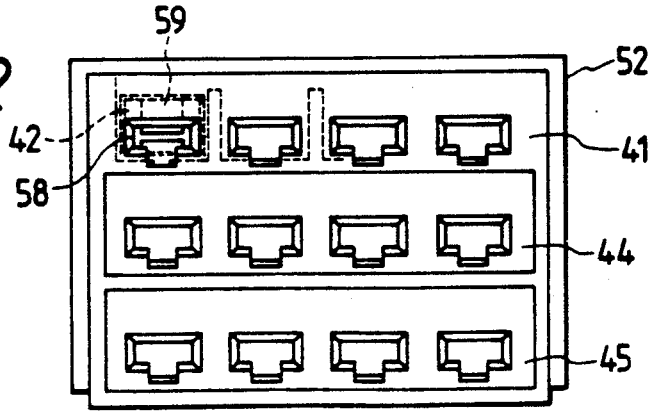
FIG. 12 is a view as viewed from the left side of FIG. 3.

FIG. 12 is a view as seen from the left side of FIG. 11. A male terminal insertion window 58 is provided at each terminal receiving chamber 42, and the male terminal insertion window 58 is engageable with a female terminal 59.

Figure 13:
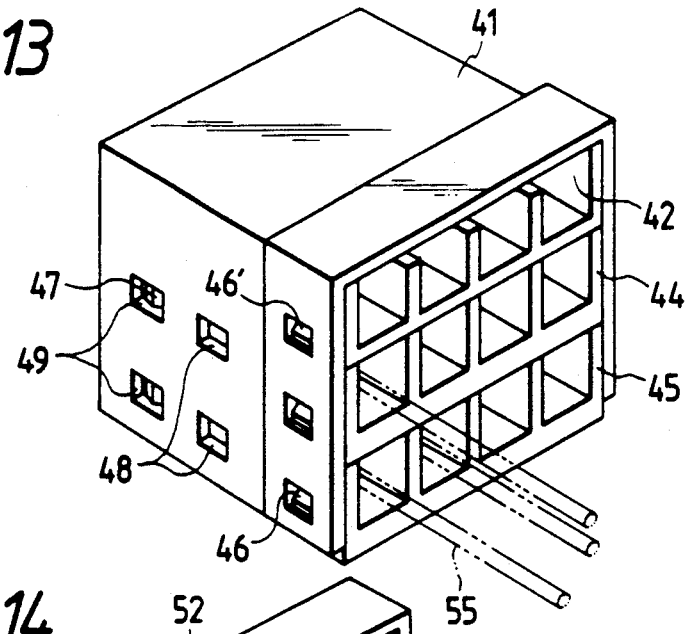
FIG. 13 is a perspective view of the multi-stage connector in its assembled condition.

FIG. 13 is a perspective view of the connector in its assembled condition in which the connections have been completed.

Figure 14:
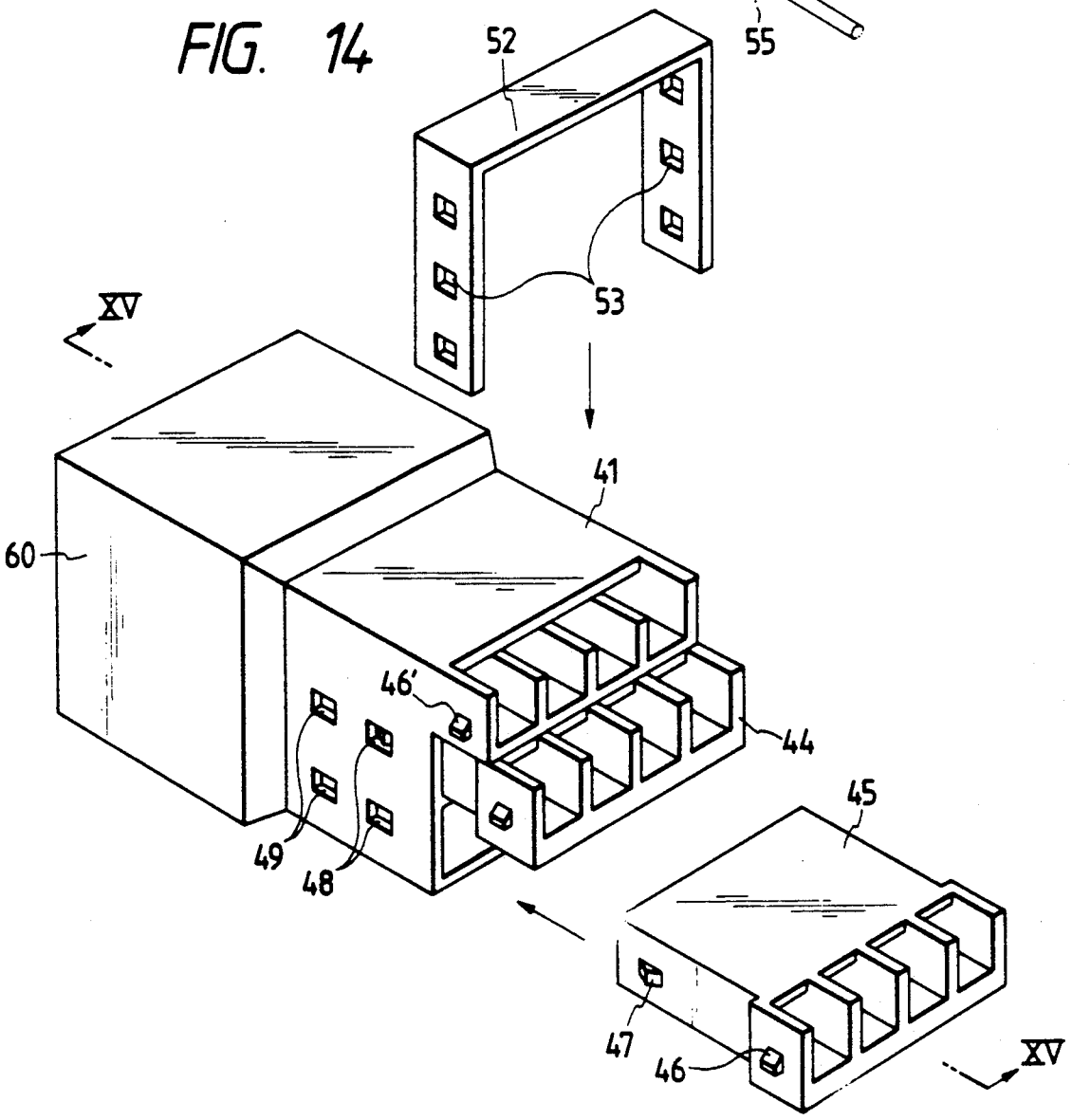
FIG. 14 is an exploded perspective view of a modified form of the invention.

FIG. 14 shows a modification of the above embodiment in which a female connector housing 60 is formed integrally with the multi-stage connector shown in FIG. 9.

Figure 15:
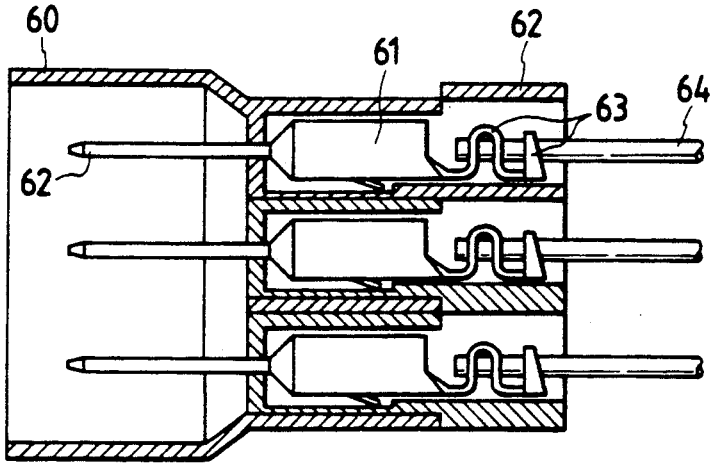
FIG. 15 is a cross-sectional view taken along the line XV—XV of FIG. 14.

More specifically, as shown in FIG. 15 which is a cross- sectional view taken along the line XV—XV of FIG. 14, a male tab terminal 62 is formed integrally with each terminal 61, and the male tab terminal 62 is disposed within the female connector housing 60. By fitting a male connector (not shown) into the female connector housing 60, the connection can be made more rapidly as compared with the above embodiment. In FIG. 15, reference numeral 63 denotes a press-connecting terminal, and reference numeral 64 denotes an electric wire.

Figure 16:
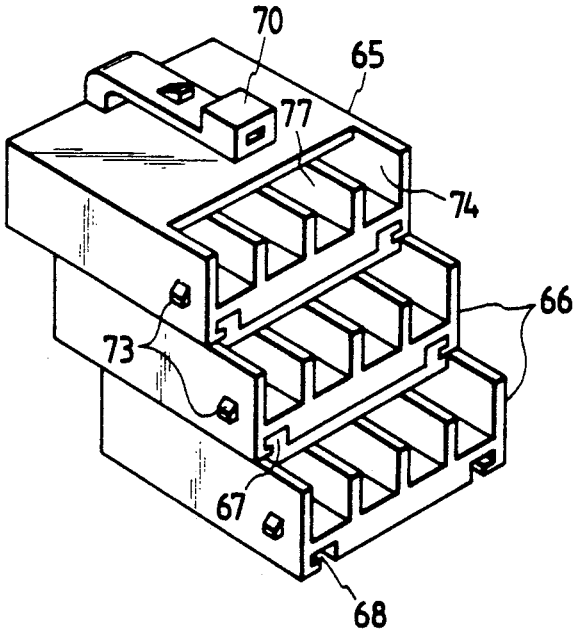
FIG. 16 is a perspective view of another modified multi- stage connector.
Figure 17:
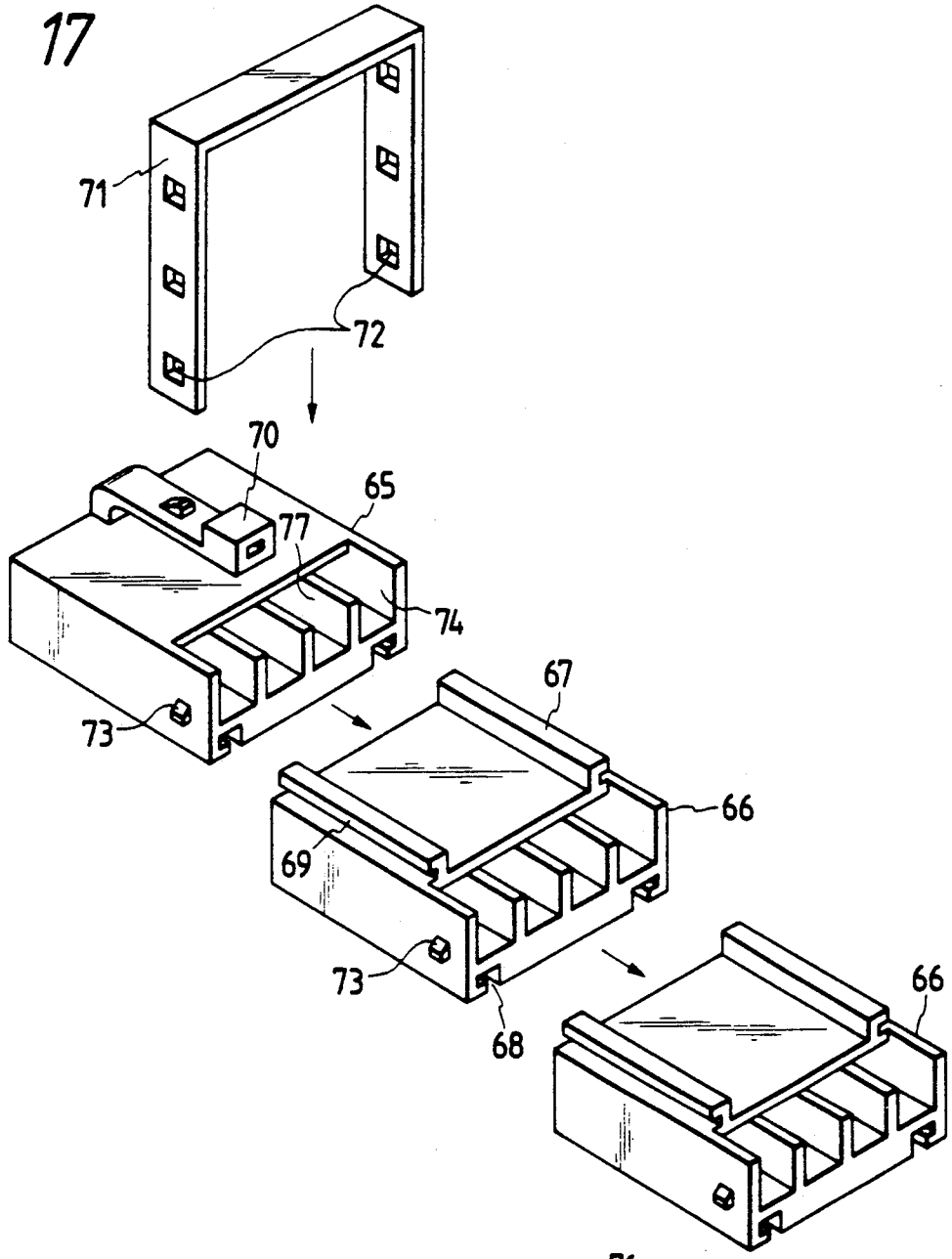
FIG. 17 is an exploded perspective view of the connector of FIG. 16.

FIG. 16 shows another modified multi-stage connector of the invention in an assembled condition, and FIG. 17 is an exploded perspective view thereof. Each slide housing 66 has slide rails 67 and slide rail-engaging grooves 68, and a plurality of slide housing 66 are slidably engaged with each other in a multi-stage manner.

The slide rails 67 are formed on the upper wall of the slide housing 66 and are disposed respectively at the opposite side portions of this upper wall, each slide rail 67 being of an L-shaped cross-section having a distal portion 69 directed outwardly. The slide rail-engaging grooves 68 are formed in the bottom wall of the slide housing 66 and are disposed respectively at the opposite side portions of this bottom wall, each groove 68 being of an L-shaped cross-section and being directed outwardly.

Instead of the slide rails, an engaging arm 70 with an engaging projection is formed on the upper wall of a slide housing 65 of the upper stage, the engaging arm 70 serving to connect the multi-stage connector to its mating connector (not shown).

In FIG. 17, reference numeral 71 denotes a housing cover having retainer windows 72 formed through opposed walls thereof. Fixing projections 73 for fitting in the retainer windows 72 are formed respectively on the opposite side walls of each of the slide housings 65 and 66. Reference numeral 74 denotes a terminal receiving chamber, and the opposite end walls of each of the slide housings 65 and 66 are removed to provide opposite open ends, and a portion of the upper wall thereof disposed close to one end thereof is removed to provide an open portion 77.

Figure 18:
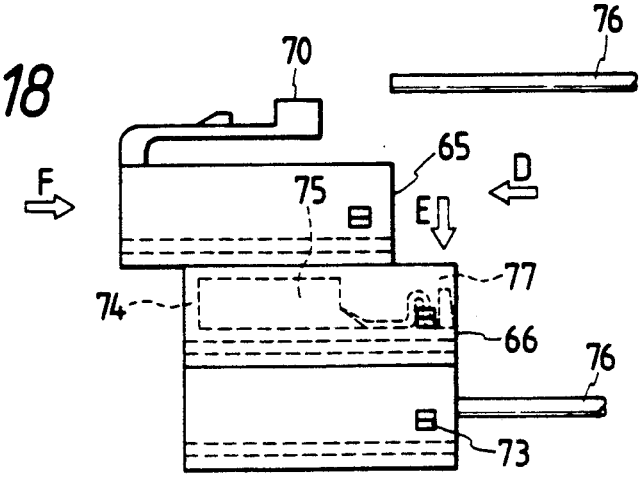
FIG. 18 is a front-elevational view of the connector of FIG. 16, showing the manner of wire connection.

FIG. 18 shows the manner of press-connecting an electric wire 76 to a press-connecting terminal 75 mounted in the terminal receiving chamber 74 of each slide housing 66. The slide housing 65 of the upper stage is urged or pushed by an automatic device (not shown) in a direction of arrow D, and the electric wire 76 is passed through the open portion 77 of the slide housing 66 of the intermediate stage in a direction of arrow E and is press-connected to the press-connecting terminal 75 of this slide housing 66. Then, the slide housing 65 of the upper stage is returned in a direction of arrow F, and the electric wire is connected to this slide housing 65 in a manner similar to the above procedure.

Alternatively, the electric wires 76 can be beforehand connected respectively to the slide housings 65 and 66, in which case the slide housings 65 and 66 are subsequently slidingly connected together.

In the embodiment of FIGS. 16 to 18, a desired number of terminal connections can be made by stacking a corresponding number of the slide housings 66 and 66. The slide housings except for the slide housing 65 of the upper stage are identical in shape, and this is very advantageous from the viewpoint of the manufacture.

As described above, in the present invention, the assemblage can be made in an automatic manner, and therefore the productivity can be improved.

A desired number of terminal connections can be easily achieved by stacking a corresponding number of the connector housings. Further, the space required for the terminal connection is less than that required in the prior art.

Further, the housings of an identical shape are used, and this is economical, and the maintenance is easy because of the interchangeability of the housings.

We claim:

1. A multi-stage connector adapted for use with an electric wire, comprising:

a connective member provided on a first connector housing; and a provisional retainer projection and a main retainer projection provided on a second connector housing, substantially similar to said first connector housing, to be connected to the first connector housing in opposed relation thereto, said retainer projections being juxtaposed in the direction of the connection; wherein said connective member is sequentially engageable with said provisional retainer projection and said main retainer projection, each of said first and second connector housings comprising press-connecting terminals on a first surface thereof and pressing portions on a second surface thereof, and wherein pressing portions on a first housing press said electric wire into said press-connecting terminal portion of an adjacent second connector housing upon respective engagement of said connective member with said provisional and main retainer projections.

2. A multi-stage connector according to claim 1, in which a press-connecting portion of a press-connecting terminal is provided on said second connector housing to be connected, said press-connecting portion being upstanding in the direction of the connection, and an electric wire-pressing projection being formed on said first connector housing to be opposed to said press-connecting terminal.

3. A method of press-connecting an electric wire in a multi-stage connector comprising a connective member provided on a first connector housing, a provisional retainer projection and a main retainer projection provided on a second connector housing, substantially similar to said first connector housing, to be connected to the first connector housing in opposed relation thereto, said retainer projections being juxtaposed in the direction of the connection, said connective member is sequentially engageable with said provisional retainer projection and said main retainer projection, wherein a press-connecting portion of a press-connecting terminal is provided on said second connector housing to be connected, said press-connecting portion being upstanding in the direction of the said second connector housing to be connected, said press-connecting portion being upstanding in the direction of the connection, and an electric wire-pressing projection being formed on said first connector housing to be opposed to said press-connecting terminal, said method comprising the steps of:

providing each of said first and second connector housings with press-connecting terminals on a first surface thereof and pressing portions on a second surface thereof;

placing the electric wire on said press-connecting terminal with said connective member engaged with said provisional retainer projection;

imparting a force to said pressing portions on a first connector housing to press said electric wire into said press-connecting terminals of an adjacent second connector housing upon respective engagement of said connective member with said provisional and main retainer projections; and engaging said connective member with said main retainer projection, so that said electric wire-pressing projection connects the wire to said press-connecting terminal.

4. A multi-stage connector in which a plurality of connector housing each having open terminal receiving chambers are slidably received in a connector housing body in a multi-stage stacked manner; a retainer projection and a fixing projection are formed on an outer surface of said connector housings a main retainer window and a provisional retainer window are formed in said connector housing body and juxtaposed in a direction of pulling of said connector housing; and a cover having fixing windows is engaged with said fixing projections.

5. A multi-stage connector adapted to be secured by a discrete housing cover, comprising:

a slide rail formed on and along substantially an entire length of a first wall of each of a plurality of connector housings each having open terminal receiving chambers, said open terminal receiving chambers each having an open end formed by removing a second wall and a portion of said first wall;

a slide rail-engaging groove formed in and along substantially an entire length of a third wall of said connector housing disposed in opposed relation to said first wall, said slide rail of said connector housing being engaged in said slide rail-engaging groove of an adjoining connector housing, thereby arranging said plurality of connector housings in a multi-stage stacked manner, said slide rail and said slide rail-engaging groove being angular-shaped and having a distal portion directed outwardly; and fixing projections formed on each of said plurality of connector housings and adapted to be retained and secured by said housing cover.

* * * * *